US005686692A

United States Patent [19]

Watson, Jr.

[11] Patent Number: 5,686,692

[45] Date of Patent: Nov. 11, 1997

[54] SINGLE FUSE FOLLOW-THROUGH GRENADE

[75] Inventor: Fred W. Watson, Jr., Montross, Va.

[73] Assignee: The United States of America as represented by the Secretary of the Navy, Washington, D.C.

[21] Appl. No.: 721,307

[22] Filed: Sep. 30, 1996

[51] Int. Cl.[6] ..... F42B 4/14; F42B 12/02; F42C 15/34

[52] U.S. Cl. ..... 102/352; 102/478; 102/479; 102/244; 102/254; 102/345

[58] Field of Search ..... 102/352, 373, 102/448, 473, 478, 477, 482, 249, 254, 415; 428/911

[56] References Cited

U.S. PATENT DOCUMENTS

| | | | |
|---|---|---|---|
| 3,103,887 | 9/1963 | Nepple | 102/56 |
| 3,267,810 | 8/1966 | Lancaster | 89/1.816 |
| 3,738,271 | 6/1973 | La Costa | 102/38 |
| 4,160,414 | 7/1979 | Stockman et al. | 102/65.2 |
| 4,846,070 | 7/1989 | Gabriels | 102/488 |
| 4,885,994 | 12/1989 | Backman et al. | 102/473 |
| 4,969,397 | 11/1990 | Günther et al. | 102/233 |
| 4,974,516 | 12/1990 | Eyal et al. | 102/476 |
| 5,000,094 | 3/1991 | Sullivan | 102/439 |
| 5,074,217 | 12/1991 | Gabriels | 102/488 |
| 5,107,766 | 4/1992 | Schliesske et al. | 102/373 |
| 5,139,328 | 8/1992 | Chan | 102/229 |
| 5,198,615 | 3/1993 | Robbie et al. | 102/476 |
| 5,594,197 | 1/1997 | Lindstadt et al. | 102/499 |

OTHER PUBLICATIONS

U.S.S.I.R. #H699, Thomas, Nov. 7, 1989.

*Primary Examiner*—Peter A. Nelson
*Attorney, Agent, or Firm*—James B. Bechtel, Esq.

[57] ABSTRACT

A follow-through grenade is provided which utilizes a primary fuze to trigger both the main warhead and a delayed secondary fuze system. The main warhead explosion is used to breach barriers behind which enemy personnel are located. When the primary explosion occurs, the primary fuze simultaneously activates a delay timer and slide detonator. The slide detonator provides a means to keep the secondary explosive in a safe mode until the explosion of the primary warhead. The delay timer triggers the follow-through explosion after the primary explosion has breached the barrier. This behavior allows the follow-through device to penetrate the barrier and explode on the far side of the barrier for maximum effectiveness against personnel located behind the barrier. The present invention uses a standard dual mode fuze as its activator and is based on the McDonnell Douglas Shoulder-launched Multipurpose Assault Weapon (SMAW).

9 Claims, 2 Drawing Sheets

SINGLE FUSE FOLLOW-THROUGH GRENADE

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention is related to the ammunition and explosives field and in particular to follow-through grenades used in anti-personnel operations.

BACKGROUND OF THE INVENTION

Increasingly, military operations have shown a strong need for weapons which can attack barriers and, after penetration, explode another charge past the barrier to be effective against personnel which were using the barrier as cover against assault. In the past, this type of penetration and assault against enemy forces required a two stage attack, the first to penetrate the barrier and then a second to launch a grenade or similar anti-personnel weapon into the breach. The prior art has recognized this need, and inventions, such as the Follow-through Grenade for Military Operations in Urban Terrain (MOUT) (U.S. Pat. No. #5,107,766), have addressed this need by housing two distinct and independent charges within a single casing and using two independent fuze systems to explode the charges at slightly different times.

However, the use of multiple independent fuzes makes these types of systems less reliable. In particular, if the sensitivity or timing of the two fuzes is off, then the effectiveness of the weapon will be impaired. Additionally, if one of the two fuzes fails, then the weapon will either fail to penetrate the barrier or fail to provide a secondary blast. What is needed is a mechanism which ties both explosive charges to a single activating mechanism, thereby improving reliability reducing complexities, weight and cost, and guarantying the differential timing of the two detonations.

SUMMARY OF THE INVENTION

It is an object of this invention to provide a weapon system which yields a primary explosion followed shortly thereafter by a secondary grenade explosion.

It is another object of the invention to provide an integrated dual fuze system such that both explosions are initiated and timed from the same activating mechanism.

Accordingly, the invention is an integrated high explosive warhead and grenade follow-through rocket having a primary fuze to detonate both the penetration charge end and to activate the fuze for the follow-through grenade. The explosives are connected to the fuze with a delay timer to allow the grenade to penetrate a breach before detonating. The warhead contains a primary warhead, a follow-through grenade and a fuze system. Upon impact with a target, the primary fuze immediately detonates the primary warhead. This explosion creates a breach in the target through which the follow-through grenade can enter. The primary fuze also ignites a fuze cord at the time of impact. The fuze cord burns through a stand-off and ignites a delayed fuze. Once the delay fuze ignites, the follow-through grenade is detonated.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
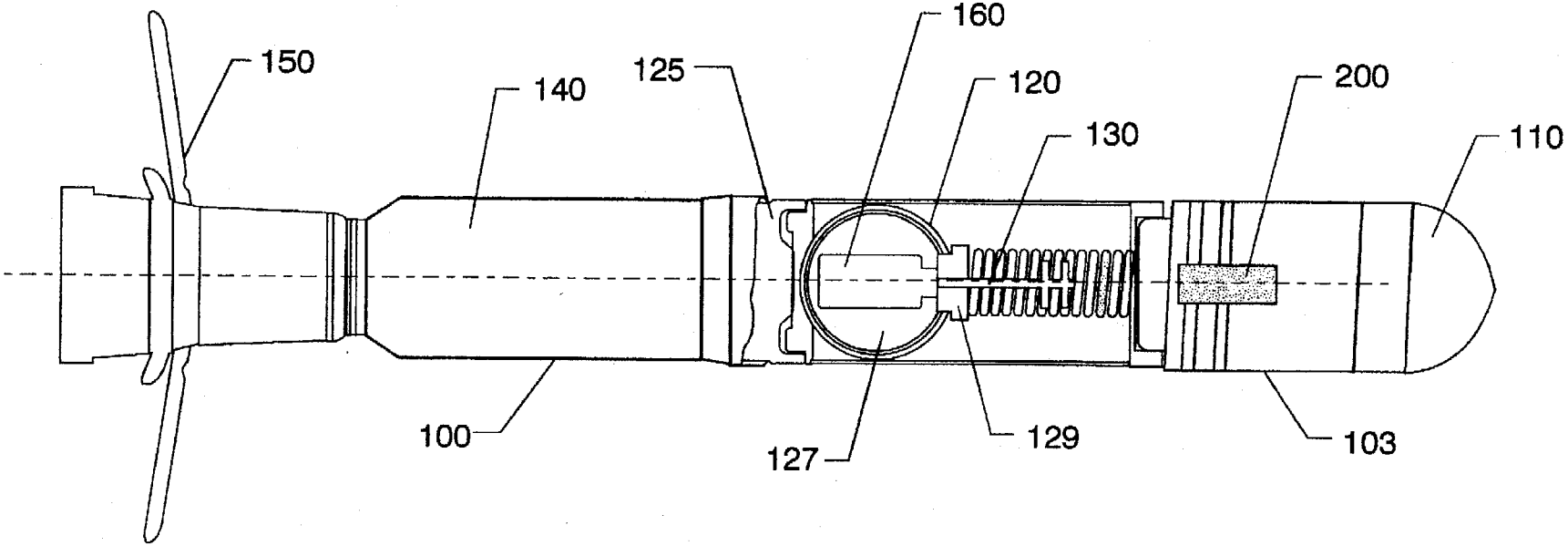
FIG. 1 is a depiction of a rocket containing both the primary warhead, detonation transfer device, and follow-through grenade.

Referring now to FIG. 1, a rocket, designated generally by the reference numeral 100, is shown with its major components. Casing 103 of the rocket includes fin assembly 150 and rocket motor 140 which provide delivery of warhead 110 to a distant target. Upon impact with the target, primary fuze 200 or a similar activating means detects the impact. Immediately upon activation of primary fuze 200, fuze detonation cord 130, which passes through forward closure 129 between grenade 120 and warhead 110, detonates warhead 110. Forward closure 129 consists of several layers of plexoglass or plastic material alternated with aluminum along the path of fuze detonation cord 130. The composition of forward closure 129 is important because the detonation of warhead 110 is of sufficient force that the shock waves from the explosion can result in a premature explosion of grenade explosives 127. The alternate layers of plexoglass and aluminum allow forward closure 129 to effectively absorb and outwardly dissipate the energy of the shock wave caused by the detonation of warhead 110.

At the same time warhead 110 is detonated, primary fuze 200 also ignites fuze detonation cord 130 which burns through to fuze system 160. Fuze system 160 delays explosion of grenade explosives 127 until warhead 110 has detonated and rocket 100 and grenade 120 have penetrated the holes opened by the explosion of warhead 110. The detonation of grenade 120 occurs after it has passed through the holes in the target barrier.

Figure 2:
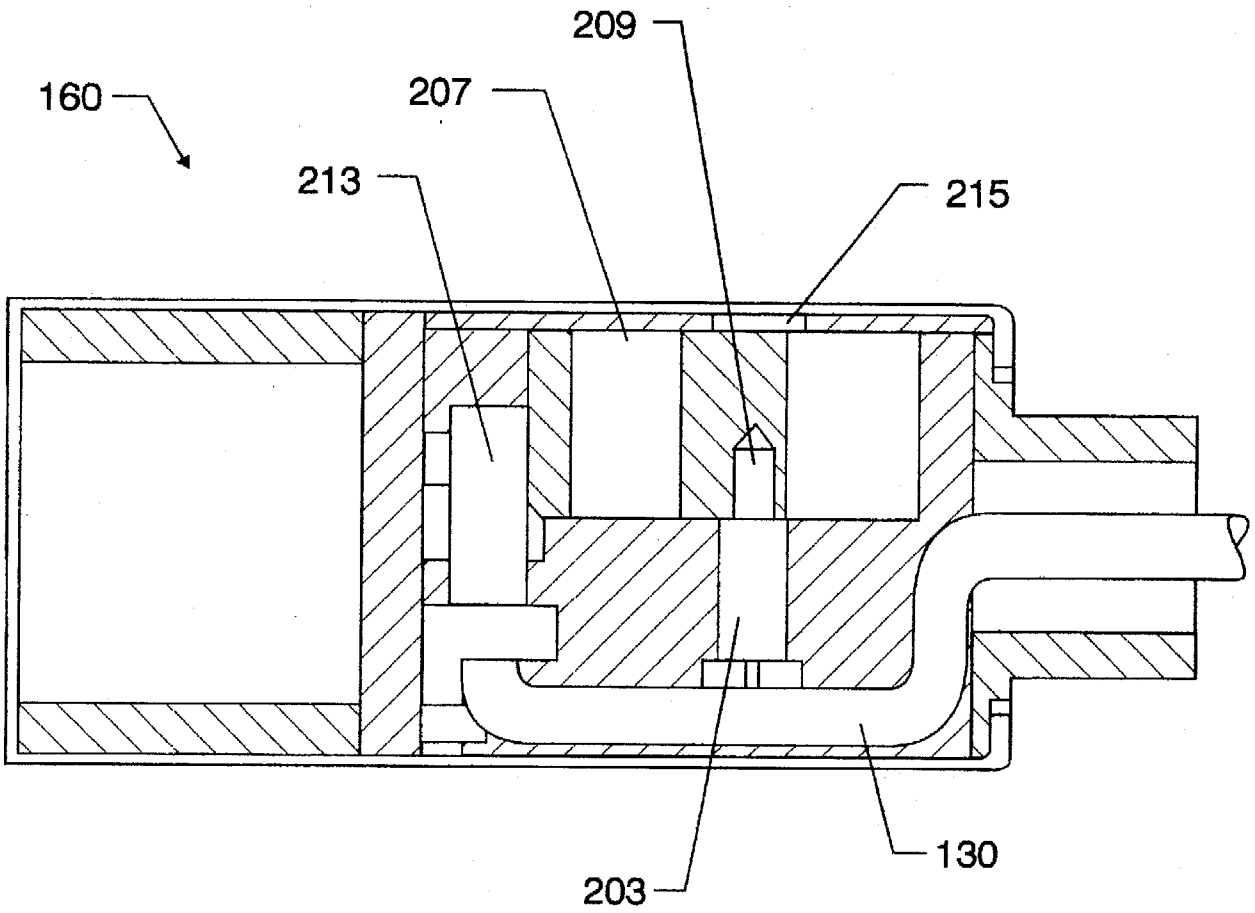
FIG. 2 is a close-up diagram of the follow-through fuze and fuze detonation cord.

FIG. 2 shows a detailed view of fuze system 160. Upon warhead impact and subsequent activation of fuze system 160, fuze detonation cord 130 is used to simultaneously initiate both the detonation of delay timer 203 and alignment detonator 213. Alignment detonator 213 explodes immediately, the force of its explosion forces fuze slider 207 along rails in fuze 160 until detonator 209 is aligned with delay timer 203. Before detonation of alignment detonator 213, fuze slider 207 is out of alignment with delay timer 203. This serves as a safety to prevent explosion of the grenade before detonation of the primary warhead.

Delay timer 203 delays ignition to allow time for the grenade to pass through the hole made by warhead 110. When delay timer 203 expires, it explodes forcing detonator 209 through fuze wall 215 and into grenade explosives 127. The impact of detonator 209 with grenade explosives 127 causes the grenade to explode.

Although the preferred embodiment uses a conventional warhead and anti-personnel grenade as warhead 110 and grenade 120 respectively, the use of any means for achieving a primary explosion and secondary explosion with the secondary explosion delayed from the primary explosion are well within the claimed art of the present invention.

This system allows both detonations to be activated by a single impact fuze. The use of a single primary fuze provides greater reliability for the entire system while reducing the complexity, weight, and cost of the system. Because there is no need to synchronize the detonation of multiple impact fuzes, the time differential between the detonation of the primary warhead and the grenade can be closely and precisely controlled. The dependent method disclosed, involving a fuze detonation cord also delays the secondary detonation of the grenade until the first, primary warhead explosion has occurred such that maximum penetration can be achieved prior to grenade explosion.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A follow-through grenade comprising:

a primary explosive means for penetrating solid targets;

a secondary explosive means for causing peripheral damage after the explosion of said primary explosive means;

a delay timer;

an alignment detonator;

a fuze slider attached to said alignment detonator and slidably attached to said delay timer;

a primary fuze means for igniting said primary explosive means; and a fuze detonation cord for said secondary explosive means, said cord being ignited by said primary fuze means and attached from said primary explosive means to said alignment detonator and said delay timer.

2. A follow-through grenade as in claim 1 wherein said secondary explosive means is an anti-personnel grenade.

3. A follow-through grenade as in claim 1 wherein said fuze detonation cord is sized to cause the simultaneous initiation of said delay timer and said alignment detonator.

4. A follow-through grenade as in claim 1 further comprising:

a casing displaced around said primary explosive means, said secondary explosive means, said delay timer, said fuze slider, said alignment detonator, said primary fuze igniting means and said fuze detonation cord; and a means for delivering said casing to a distant target.

5. A follow-through grenade as in claim 4 wherein said casing is a warhead and said delivering means is a rocket motor.

6. A follow-through grenade as in claim 1 wherein said primary explosive means is a standard warhead.

7. A follow-through grenade as in claim 1 wherein said delay timer, said fuze slider, and said alignment detonator are displaced within said secondary explosive means.

8. A follow-through grenade as in claim 1 further comprising a closure attached to said primary explosive means and said secondary explosive means and having said fuze detonation cord passing through it.

9. A follow-through grenade as in claim 8 wherein said closure is comprised of a plurality of layers of materials having a different density such that the compression of the layers leads to the absorption and dissipation of the shock wave caused by the explosion of said primary explosive means.

* * * * *